US008860767B2

(12) United States Patent
Yu et al.

(10) Patent No.: US 8,860,767 B2
(45) Date of Patent: Oct. 14, 2014

(54) GAMMA REFERENCE VOLTAGE GENERATION CIRCUIT AND FLAT PANEL DISPLAY USING THE SAME

(75) Inventors: Sangho Yu, Gumi-si (KR); Jaedo Lee, Gumi-si (KR); Youngjun Hong, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 1017 days.

(21) Appl. No.: 12/458,281

(22) Filed: Jul. 7, 2009

(65) Prior Publication Data

US 2010/0007680 A1 Jan. 14, 2010

(30) Foreign Application Priority Data

Jul. 8, 2008 (KR) ..... 10-2008-0066188

(51) Int. Cl.
*G09G 5/10* (2006.01)
*G09G 3/20* (2006.01)

(52) U.S. Cl.
CPC ..... *G09G 5/10* (2013.01); *G09G 2320/0276* (2013.01); *G09G 2320/041* (2013.01); *G09G 3/2003* (2013.01)
USPC ..... 345/690; 345/89; 327/530

(58) Field of Classification Search
USPC ..... 345/80, 82–84, 87–100, 204, 207–214, 345/690; 348/674; 327/530
See application file for complete search history.

(56) References Cited

U.S. PATENT DOCUMENTS 6,452,526 B2 * 9/2002 Sagawa et al. ..... 341/144
6,798,146 B2 * 9/2004 Oota ..... 315/169.1
7,224,351 B2 * 5/2007 Lee ..... 345/205
7,554,517 B2 * 6/2009 Baum et al. ..... 345/89
7,859,524 B2 * 12/2010 Lee ..... 345/205
8,614,656 B2 * 12/2013 Hashimoto et al. ..... 345/77
2003/0067435 A1 * 4/2003 Liu ..... 345/101
2003/0122814 A1 * 7/2003 Yer ..... 345/211
2006/0114205 A1 * 6/2006 Shen et al. ..... 345/88
2006/0244692 A1 * 11/2006 Yoo ..... 345/76
2007/0200808 A1 * 8/2007 Lee ..... 345/88
2007/0236437 A1 * 10/2007 Lee et al. ..... 345/88
2009/0015574 A1 * 1/2009 Kim et al. ..... 345/208

FOREIGN PATENT DOCUMENTS

JP 2006-309127 11/2006
JP 2007-047791 2/2007
JP 2007-114703 5/2007
KR 10-2006-0113009 11/2006

* cited by examiner

*Primary Examiner* — William Boddie
*Assistant Examiner* — Mansour M Said
(74) *Attorney, Agent, or Firm* — McKenna Long & Aldridge LLP

(57) ABSTRACT

A gamma reference voltage generation circuit and a flat panel display using the same are provided. The gamma reference voltage generation circuit includes R, G and B gamma reference voltage generators each having a plurality of digital-to-analog converters (DACs) that generate a plurality of R, G and B gamma reference voltages. In the DACs of each of the R, G and B gamma reference voltage generators, a high potential bias voltage input terminal of an uppermost DAC used to generate a gamma reference voltage of a maximum gray level is connected to a high potential voltage source. A high potential bias voltage input terminal of each of remaining DACs except the uppermost DAC is cascade-connected to an output terminal of an upper DAC next to each of the remaining DACs.

6 Claims, 12 Drawing Sheets

GAMMA REFERENCE VOLTAGE GENERATION CIRCUIT AND FLAT PANEL DISPLAY USING THE SAME

This application claims the benefit of Korea Patent Application No. 10-2008-0066188 filed on Jul. 8, 2008, the entire contents of which is incorporated herein by reference for all purposes as if fully set forth herein.

BACKGROUND OF THE INVENTION

1. Field of the Invention

Embodiments relate to a gamma reference voltage generation circuit and a flat panel display using the same.

2. Discussion of the Related Art

Various flat panel displays, whose weight and size are smaller than weight and size of cathode ray tubes, have been recently developed. Examples of the flat panel displays include a liquid crystal display (LCD), a plasma display panel (PDP), a field emission display (FED), and an organic light emitting diode (OLED) display. These flat panel displays have been put to practical use and have been selling.

The liquid crystal display and the OLED display each include a display panel displaying an image in response to driving voltages and driving circuits supplying the driving voltages to the display panel. A plurality of pixels are arranged on the display panel in a matrix format. The plurality of pixels each include an active switching element. In the liquid crystal display, a gray level is represented by controlling a light transmittance of a liquid crystal layer included in the display panel depending on a magnitude of the driving voltage applied to the display panel. In the OLED display, a gray level is represented by controlling an amount of current flowing in an organic light emitting diode depending on a magnitude of the driving voltage applied to the display panel.

Generally, a gray scale may mean that an amount of light that he or she perceives through his or her eye is divided in stages. According to Weber's law, human eye nonlinearly acts on brightness of light. Therefore, if he or she linearly measures changes in brightness of light through his or her eye within a limited bit depth such as k-bit per channel, he or she perceives the brightness of light intermittently change when an amount of light changes. Namely, posterization occurs. Accordingly, the brightness of light needs to be nonlinearly decoded so as to achieve the optimum image quality within a limited bit depth. For this, a difference between driving characteristics of the display panel and characteristics perceived through human eye must be removed. The removing process is called a gamma correction. Generally, a gamma correction method includes setting a plurality of gamma reference voltages fixed depending on the driving characteristics of the display panel, dividing each of the set gamma reference voltages, and compensating gamma values of digital video data.

FIG. 1 shows a gamma correction circuit of a related art flat panel display.

As shown in FIG. 1, a related art gamma correction circuit includes a plurality of digital-to-analog converters (DACs) DAC#k, DAC#k-1, DAC#k-2 . . . respectively generating gamma reference voltages VRG_k, VRG_k-1, VRG_k-2 . . . corresponding to gamma data GMA_Data received from the outside and a resistance string R-String generating a plurality of gamma voltages using the gamma reference voltages VRG_k, VRG_k-1, VRG_k-2 . . . being tap voltages. The DACs DAC#k, DAC#k-1, DAC#k-2 . . . are electrically separated from one another to respectively supply the gamma reference voltages VRG_k, VRG_k-1, VRG_k-2 . . . to tap terminals inside the resistance string R-String. The resistance string R-String divides each of the gamma reference voltages VRG_k, VRG_k-1, VRG_k-2 . . . to generate a plurality of gamma voltages.

On the other hand, the related art flat panel display has the following problems.

Firstly, because the DACs generate the gamma reference voltages independently of one another, the gamma reference voltage inside the resistance string generated by one DAC of the DACs is fixed irrespective of changes in the gamma reference voltage generated by the DAC next to the one DAC. Therefore, when a corresponding gamma reference voltage having a predetermined range needs to change so that an output luminance and a color coordinate are corrected, all the gamma reference voltages other than the corresponding gamma reference voltage have to be individually controlled so as to accord the output luminance characteristics with a desired gamma curve through gamma correction. Namely, the gamma correction causes so much trouble.

Secondly, because a gamma characteristic of the related art flat panel display is determined by a gamma curve of approximately 1.8 to 2.2, a difference between low gray levels are unclear. Namely, a capability to represent a low gray level falls.

SUMMARY OF THE INVENTION

Embodiments provide a gamma reference voltage generation circuit and a flat panel display using the same capable of simply performing a gamma correction process for correcting an output luminance or a color coordinate.

Embodiments provide a gamma reference voltage generation circuit and a flat panel display using the same capable of precisely performing a gamma correction process at a low gray level.

In one aspect, there is a gamma reference voltage generation circuit comprising a red (R) gamma reference voltage generator including a plurality of digital-to-analog converters (DACs), each of which generates an R gamma reference voltage corresponding to R gamma data, a green (G) gamma reference voltage generator including a plurality of DACs, each of which generates a G gamma reference voltage corresponding to G gamma data, and a blue (B) gamma reference voltage generator including a plurality of DACs, each of which generates a B gamma reference voltage corresponding to B gamma data, wherein in the DACs of each of the R, G and B gamma reference voltage generators, a high potential bias voltage input terminal of an uppermost DAC used to generate a gamma reference voltage of a maximum gray level is connected to a high potential voltage source, and wherein a high potential bias voltage input terminal of each of remaining DACs except the uppermost DAC is cascade-connected to an output terminal of an upper DAC next to each of the remaining DACs.

Low potential bias voltage input terminals of the DACs are commonly connected to a ground level voltage source.

In the DACs of each of the R, G and B gamma reference voltage generators, a low potential bias voltage input terminal of a lowermost DAC used to generate a gamma reference voltage of a minimum gray level is connected to a ground level voltage source. A low potential bias voltage input terminal of each of remaining DACs except the lowermost DAC is cascade-connected to an output terminal of a lower DAC next to each of the remaining DACs.

The high potential bias voltage input terminal of the uppermost DAC is connected to the high potential voltage source through a temperature compensator.

The temperature compensator includes a temperature sensor that is connected to the high potential voltage source to lowers an output voltage of the temperature sensor when an ambient temperature is higher than a normal temperature and to increase the output voltage of the temperature sensor when the ambient temperature is lower than the normal temperature, and a comparator that differentially amplifies the output voltage of the temperature sensor and a predetermined reference voltage and supplies the amplified voltages to the high potential bias input terminal of the uppermost DAC.

In another aspect, there is a flat panel display comprising a display panel including red (R), green (G) and blue (B) pixels, a memory that stores R, G and B gamma data received from the outside, a gamma reference voltage generation circuit that generates a plurality of R, G and B gamma reference voltages corresponding to the R, G and B gamma data loaded from the memory, and a data driving circuit that divides each of the plurality of R, G and B gamma reference voltages to generate a plurality of R, G and B gamma voltages and supplies the R, G and B gamma voltages as a data voltage to the display panel, wherein the gamma reference voltage generation circuit includes R, G and B gamma reference voltage generators each having a plurality of digital-to-analog converters (DACs) that generate the plurality of R, G and B gamma reference voltages, wherein in the DACs of each of the R, G and B gamma reference voltage generators, a high potential bias voltage input terminal of an uppermost DAC used to generate a gamma reference voltage of a maximum gray level is connected to a high potential voltage source, and wherein a high potential bias voltage input terminal of each of remaining DACs except the uppermost DAC is cascade-connected to an output terminal of an upper DAC next to each of the remaining DACs.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Reference will now be made in detail embodiments of the invention examples of which are illustrated in the accompanying drawings.

Figure 1:
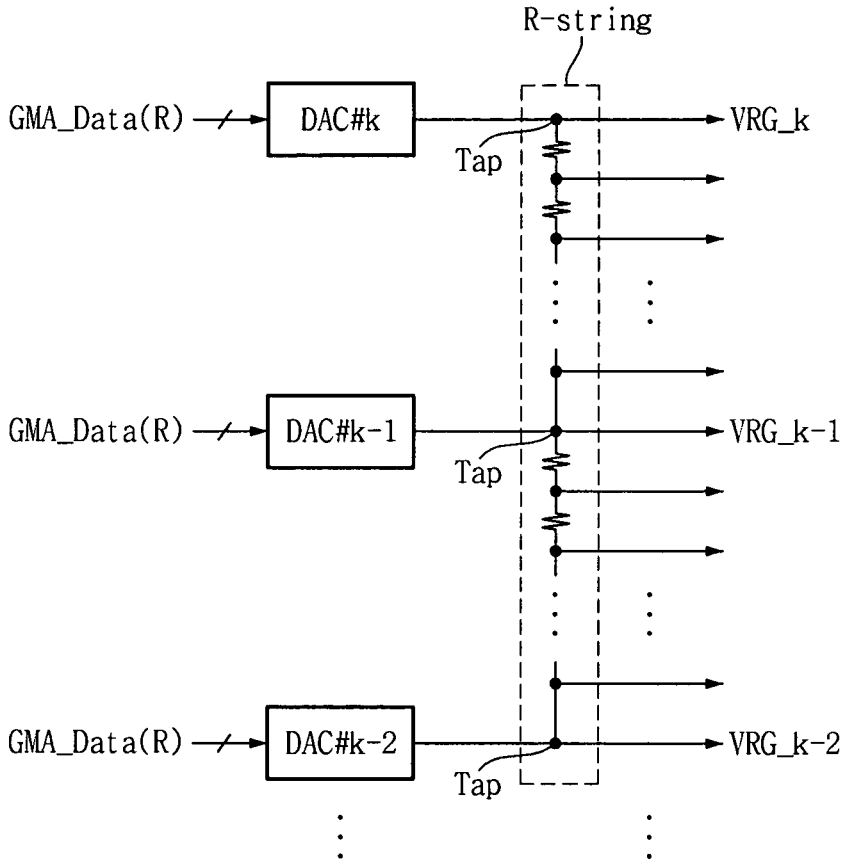
FIG. 1 (Related Art)
FIG. 1 illustrates a gamma correction circuit of a related art flat panel display.
Figure 2:
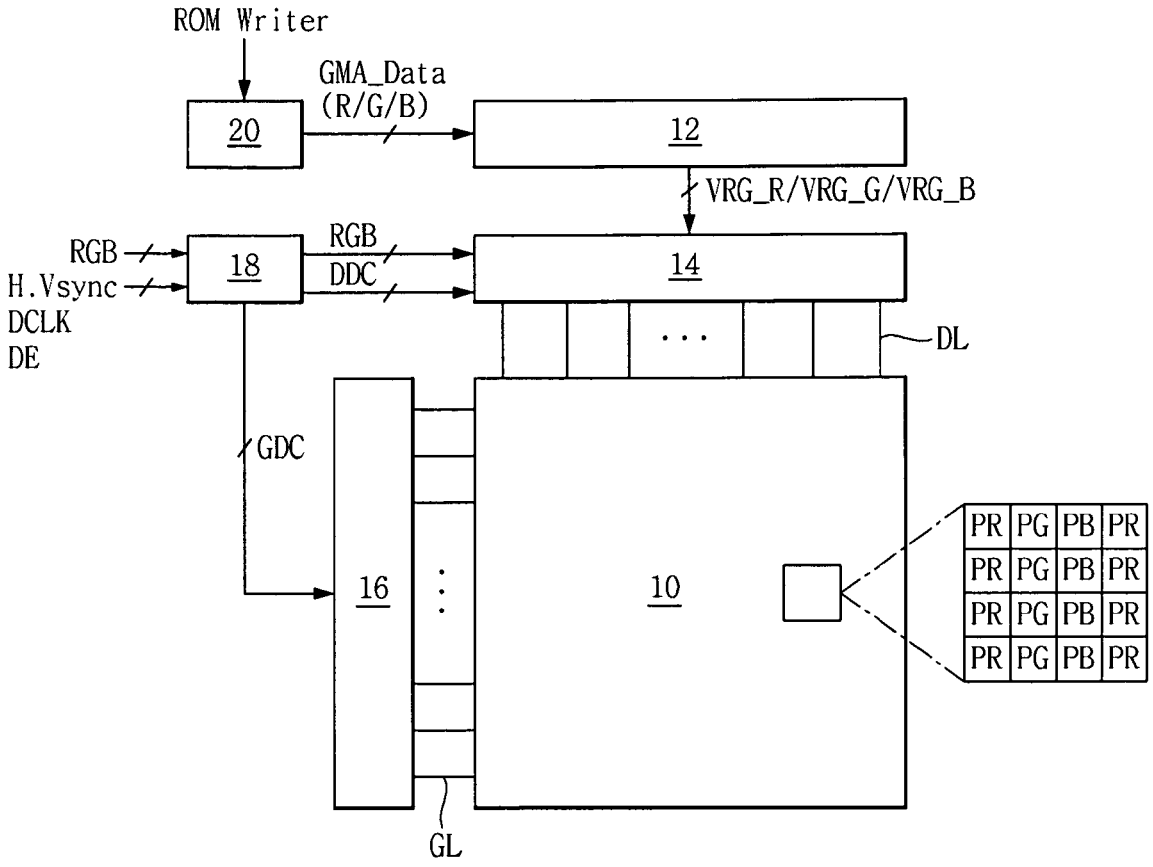
FIG. 2 is a block diagram of an exemplary configuration of a flat panel display according to an embodiment.

FIG. 2 is a block diagram of an exemplary configuration of a flat panel display according to an embodiment.

As show in FIG. 2, a flat panel display according to an embodiment includes a display panel 10, a gamma reference voltage generation circuit 12, a data driving circuit 14, a gate driving circuit 16, a timing controller 18, and a memory 20.

The display panel 10 includes a plurality of data lines DL and a plurality of gate lines GL crossing each other and R, G and B pixels PR, PG and PB at each of crossings of the data lines DL and the gate lines GL. The pixels PR, PG and PB generate display light using a data voltage received from the data lines DL to achieve a gray level. The data voltage is an analog gamma voltage based on an input digital video data RGB.

Figure 3:
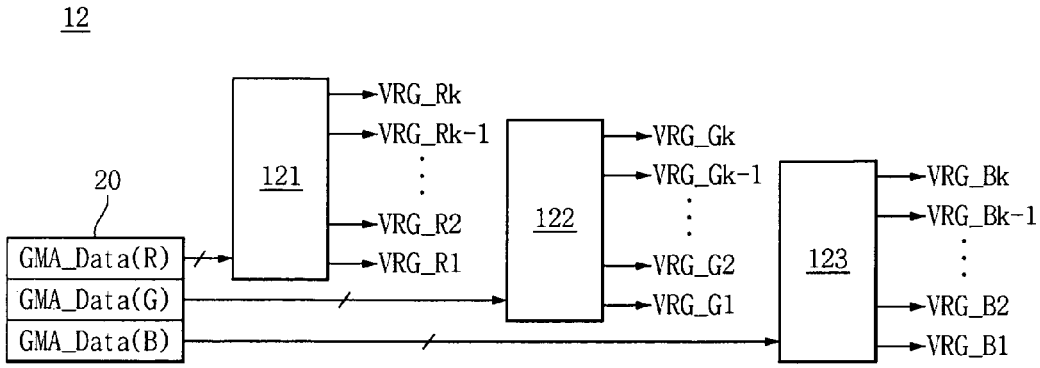
FIG. 3 schematically illustrates a gamma reference voltage generation circuit of the flat panel display shown in FIG. 2.

The gamma reference voltage generation circuit 12 generates R, G and B gamma reference voltages VRG_R, VRG_G and VRG_B in response to gamma data GMA_Data(R/G/B) received from the memory 20. The gamma reference voltage generation circuit 12, as shown in FIG. 3, includes a red (R) gamma reference voltage generator 121, a green (G) gamma reference voltage generator 122, and a blue (B) gamma reference voltage generator 123.

The R gamma reference voltage generator 121 generates a plurality of R gamma reference voltages VRG_R1 to VRG_Rk in response to R gamma data GMA_Data(R) received from the memory 20. For this, the R gamma reference voltage generator 121 includes a plurality of resisters for loading the R gamma data GMA_Data(R) and a plurality of digital-to-analog converters (DACs) that are respectively connected to the plurality of resisters to generate the R gamma reference voltages VRG_R1 to VRG_Rk corresponding to data values stored in the resisters.

The G gamma reference voltage generator 122 generates a plurality of G gamma reference voltages VRG_G1 to VRG_Gk in response to G gamma data GMA_Data(G) received from the memory 20. For this, the G gamma reference voltage generator 122 includes a plurality of resistors for loading the G gamma data GMA_Data(G) and a plurality of DACs that are respectively connected to the plurality of resistors to generate the G gamma reference voltages VRG_G1 to VRG_Gk corresponding to data values stored in the resistors.

The B gamma reference voltage generator 123 generates a plurality of B gamma reference voltages VRG_B1 to VRG_Bk in response to B gamma data GMA_Data(B) received from the memory 20. For this, the B gamma reference voltage generator 123 includes a plurality of registers for loading the B gamma data GMA_Data(B) and a plurality of DACs that are respectively connected to the plurality of registers to generate B gamma reference voltages VRG_B1 to VRG_Bk corresponding to data values stored in the registers.

Each of the DACs included in each of the R, G and B gamma reference voltage generators 121, 122 and 123 operates by a high potential bias voltage and a low potential bias voltage. In particular, a high potential bias voltage input terminal of each DAC is connected to an output terminal of an upper DAC directly next to it, and thus the DACs are cascade-connected to one another. Further, the DACs of the gamma reference voltage generation circuit 12 may be cascade-connected to one another by connecting a high potential bias voltage input terminal of each DAC to an output terminal of an upper DAC directly next to it and connecting a low potential bias voltage input terminal of each DAC to an output terminal of a lower DAC directly next to it. The gamma reference voltage generation circuit 12 will be described in detail below with reference to FIGS. 5 to 11.

Figure 4:
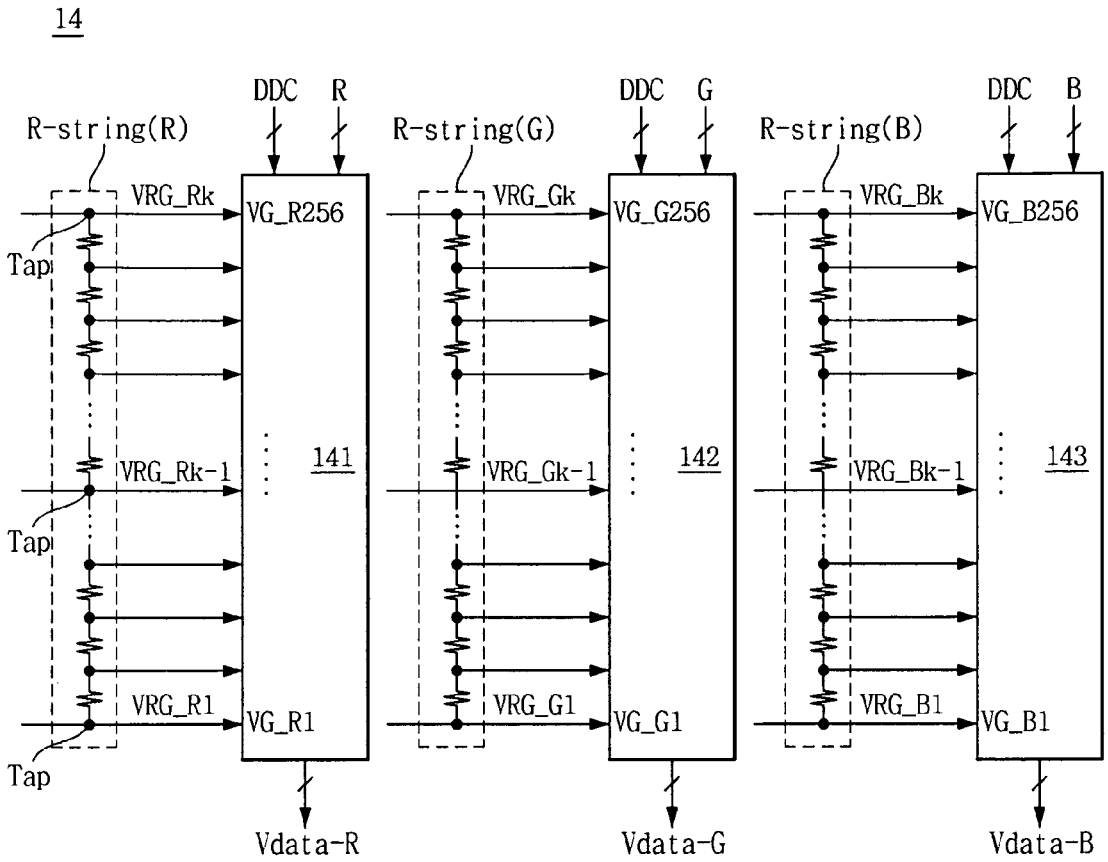
FIG. 4 illustrates a data driving circuit of the flat panel display shown in FIG. 2.

The data driving circuit 14 divides the gamma reference voltages VRG received from the gamma reference voltage generation circuit 12 to generate a plurality of gamma voltages VG. The data driving circuit 14 converts the digital video data RGB into the gamma voltage VG in response to a data control signal DDC and supplies the gamma voltage VG to the data lines DL of the display panel 10. In this case, the gamma voltage VG serves as a data voltage Vdata. For this, the data driving circuit 14, as shown in FIG. 4, includes an R data driver 141 connected to a resistance string R-String(R), a G data driver 142 connected to a resistance string R-String (G), and a B data driver 143 connected to a resistance string R-String(B).

The resistance strings R-String(R), R-String(G) and R-String(B) respectively divide R gamma reference voltages VRG_R1 to VRG_Rk, G gamma reference voltages VRG_G1 to VRG_Gk, and B gamma reference voltages VRG_B1 to VRG_Bk to respectively generate R gamma voltages VG_R1 to VG_R256, G gamma voltages VG_G1 to VG_G256, and B gamma voltages VG_B1 to VG_B256. The R, G and B gamma reference voltages are tap voltages.

The R data driver 141 selects an R gamma voltage corresponding to a gray level of R digital video data input in response to the data control signal DDC and supplies the R gamma voltage serving as an R data voltage Vdata-R to the data lines GD. The G data driver 142 selects a G gamma voltage corresponding to a gray level of G digital video data input in response to the data control signal DDC and supplies the G gamma voltage serving as a G data voltage Vdata-G to the data lines GD. The B data driver 143 selects a B gamma voltage corresponding to a gray level of B digital video data input in response to the data control signal DDC and supplies the B gamma voltage serving as a B data voltage Vdata-B to the data lines GD.

The gate driving circuit 16 sequentially supplies scan pulses for selecting horizontal lines of the display panel 10, to which the data voltages will be supplied, to the gate lines GL of the display panel 10.

The timing controller 18 rearranges the digital video data RGB received from an external system board in conformity with a resolution of the display panel 10 to supply the rearranged digital video data RGB to the data driving circuit. 14. The timing controller 18 receives timing signals, such as vertical and horizontal sync signals Vsync and Hsync, a data enable signal DE, a dot clock signal CLK to generate control signals DDC and GDC for controlling operation timing of the data driving circuit 14 and operation timing of the gate driving circuit 16.

The memory 20 receives the gamma data GMA_Data(R/G/B), that is experimentally determined to correct a color coordinate and/or an output luminance, from a read only memory (ROM) writer to store the gamma data GMA_Data (R/G/B). The memory 20 includes a data updatable and erasable nonvolatile memory, for example, an electrically erasable programmable ROM (EEPROM) and/or an extended display identification data ROM (EDID ROM). When a power is applied to the external system board, the gamma data GMA_Data(R/G/B) stored in the memory 20 is loaded into the registers of the gamma reference voltage generation circuit 12. The exemplary embodiment may include a separate optical sensor and a separate image processor for the correction of color coordinate instead of the external memory. More specifically, the optical sensor may detect a luminance difference between red, green, and blue, and the image processor may correct the luminance difference in conformity with the color coordinate. Hence, the gamma data may be corrected, and then the corrected gamma data may be supplied to the registers of the gamma reference voltage generation circuit 12. In this case, it is preferable that the register is implemented as a nonvolatile memory for preservation of the corrected gamma data.

Figure 5:
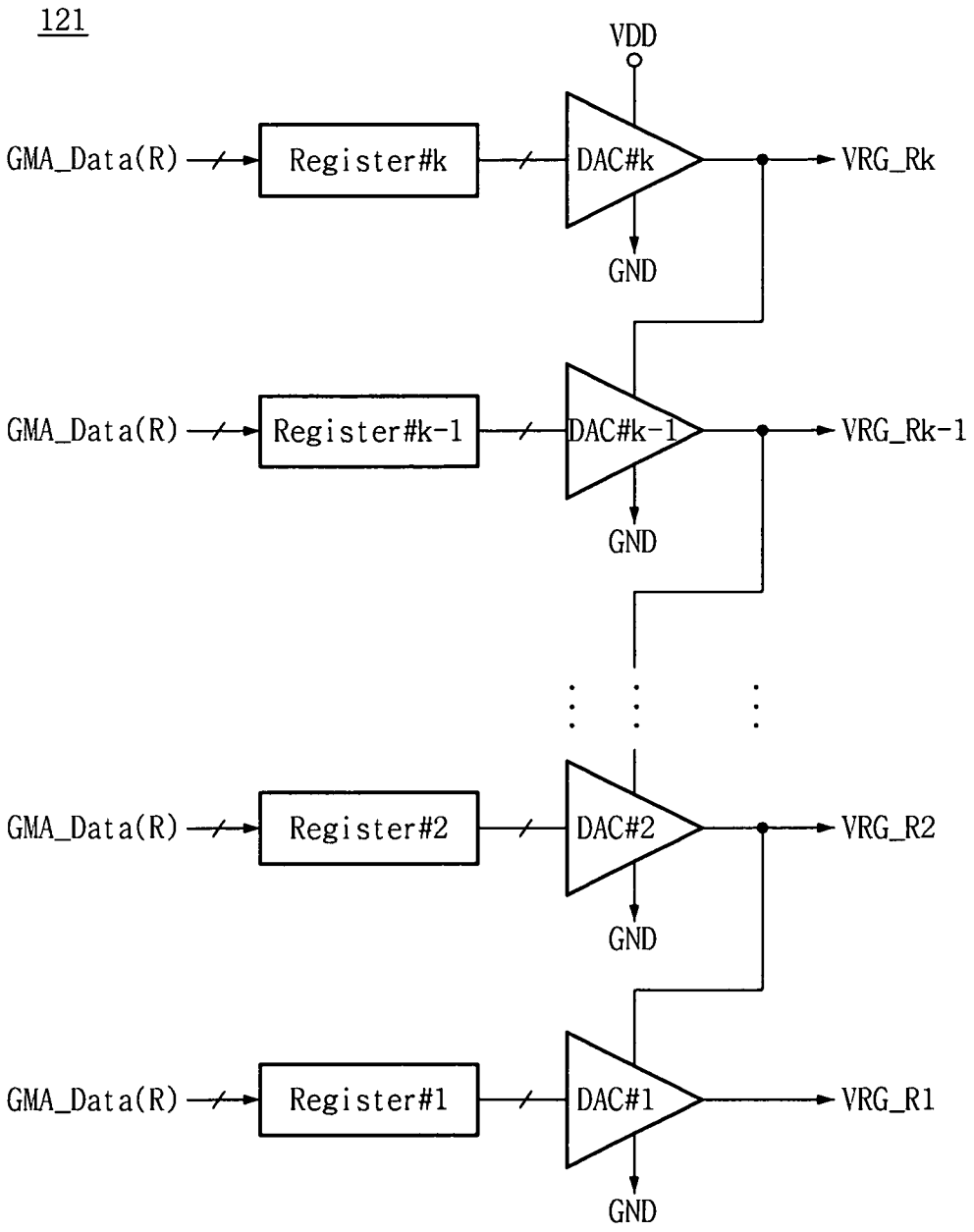
FIGS. 5 and 6 illustrate a first implementation of an R gamma reference voltage generator of a gamma reference voltage generation circuit according to an embodiment.
Figure 6:
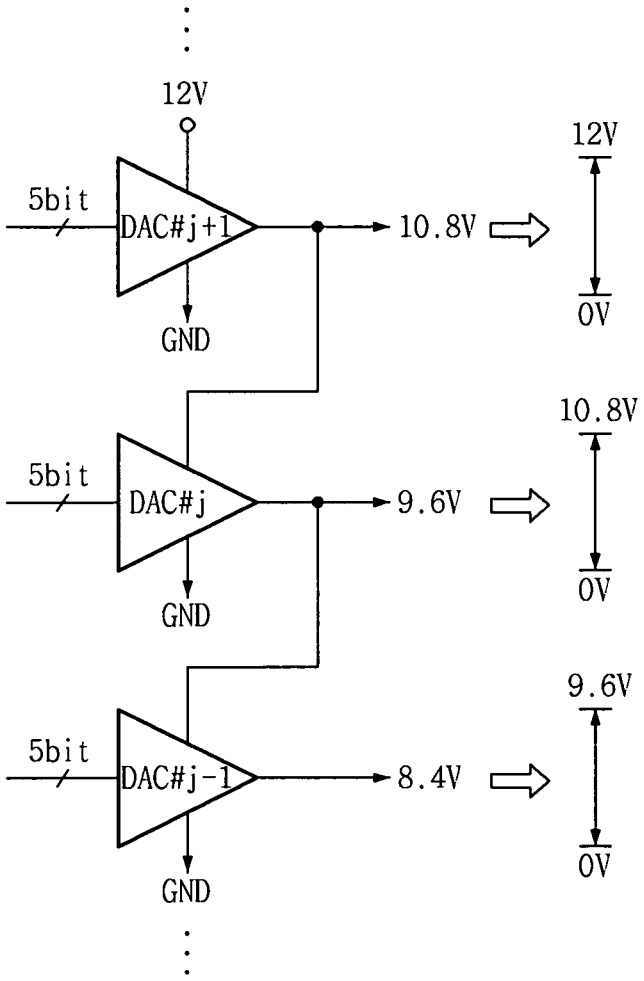

FIGS. 5 and 6 illustrate a first implementation of the R gamma reference voltage generator 121 of the gamma reference voltage generation circuit 12. Since configurations of the G gamma reference voltage generator 122 and the B gamma reference voltage generator 123 are substantially the same as the R gamma reference voltage generator 121 except input and output signals, a further description may be briefly made or may be entirely omitted.

As shown in FIG. 5, the R gamma reference voltage generator 121 includes k registers, into which R gamma data GMA_Data(R) is loaded, and k DACs, that are respectively connected to the k registers to generate R gamma reference voltages corresponding to data values stored in the k registers.

Figure 8:
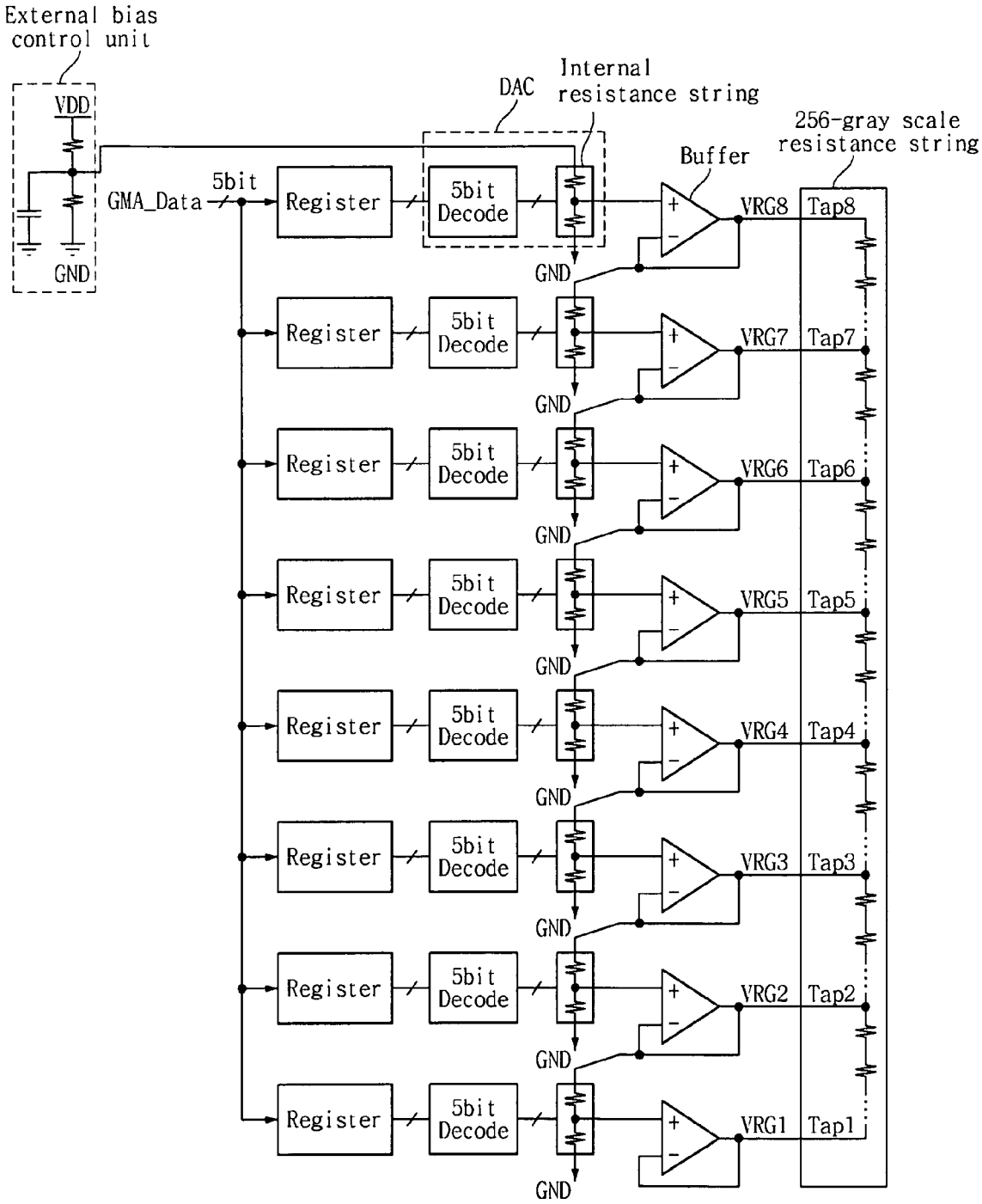
FIG. 8 illustrates an exemplary configuration of a gamma reference voltage generation circuit connected to a 256-gray scale resistance string according to the first implementation.

Each DAC includes a decoder for decoding the R gamma data GMA_Data(R) and a voltage division internal resistance string for selecting an R gamma reference voltage VRG_R depending on the decoded R gamma data GMA_Data(R). The number of voltage division nodes in the internal resistance string may vary depending on a bit rate of the R gamma data GMA_Data(R). For example, if the R gamma data GMA_Data(R) is 5-bit, the internal resistance string may have 25 voltage division nodes. Voltage levels of the voltage division nodes are determined by a high potential bias voltage and a low potential bias voltage applied to both terminals of the internal resistance string. A high potential bias voltage input terminal of each of the DACs is connected to an output terminal of an upper DAC directly next to it, and thus the DACs of the R gamma reference voltage generator are cascade-connected to one another. A high potential bias voltage input terminal of an uppermost DAC of the R gamma reference voltage generator is directly connected to a high potential voltage source VDD or is connected to the high potential voltage source VDD via an external bias control unit as shown in FIG. 8. All of low potential bias voltage input terminals of the DACs are connected to a ground level voltage source GND.

For example, as shown in FIG. 6, a high potential bias voltage input terminal of a (j+1)-th DAC is connected to an output terminal (having 12 V) of its upper DAC, a high potential bias voltage input terminal of a j-th DAC is connected to an output terminal (having 10.8 V) of the (j+1)-th DAC, and a high potential bias voltage input terminal of a (j−1)-th DAC is connected to an output terminal (having 9.6 V) of the j-th DAC. Hence, the (j+1)-th DAC outputs a divided voltage of 10.8 V corresponding to a decoding value of the R gamma data GMA_Data(R) (=5-bit) among 32 divided voltages within a range between 0 V and 12 V as a (j+1)-th gamma reference voltage to thereby generate a gamma reference voltage of a relatively high gray level. The j-th DAC outputs a divided voltage of 9.6 V corresponding to the decoding value of the R gamma data GMA_Data(R) (=5-bit) among 32 divided voltages within a range between 0 V and 10.8 V as a j-th gamma reference voltage to thereby generate a gamma reference voltage of a relatively middle gray level. The (j−1)-th DAC outputs a divided voltage of 8.4 V depending on a decoding value of the R gamma data GMA_Data(R) (=5-bit) among 32 divided voltages within a range between 0 V and 9.6 V as a (j−1)-th gamma reference voltage to thereby generate a gamma reference voltage of a relatively low gray level.

As can be seen from the example illustrated in FIG. 6, because the gamma reference voltage generation circuit according to the first implementation includes the cascade-connected DACs, when a corresponding gamma reference voltage having a predetermined range needs to change so that an output luminance and a color coordinate are corrected, only the corresponding gamma reference voltage is individually controlled. In other words, gamma reference voltages of a gray level lower than a gray level of the corresponding gamma reference voltage can automatically controlled in conformity with a desired gamma curve by controlling only the corresponding gamma reference voltage.

Figure 7:
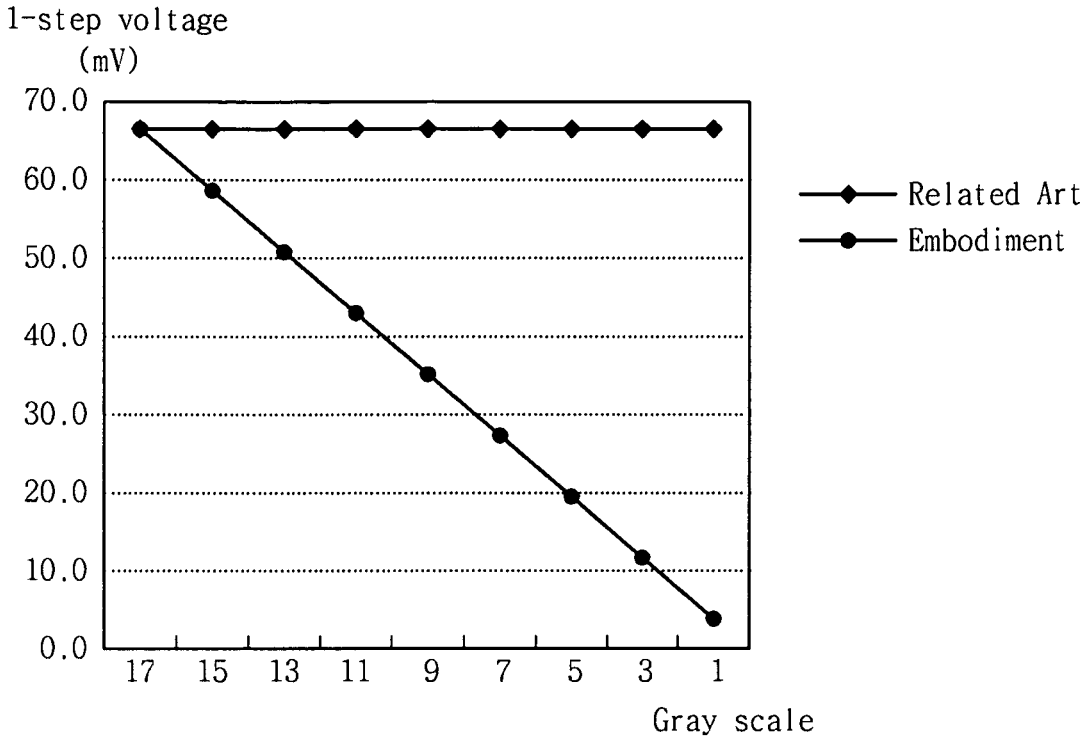
FIG. 7 shows that a magnitude of 1-step voltage is reduced as a gray level becomes lower according to the first implementation.

Further, because the gamma reference voltage generation circuit according to the first implementation includes the cascade-connected DACs, as shown in FIG. 7, a magnitude of 1-step voltage in the first implementation decreases at a decreasing gray level as compared with the related art. Therefore, a gamma representation on a gamma curve of 1.8 to 2.2 can be achieved more precisely by increasing an output precision of the DAC at a low gray level. This is because a case where an output voltage 9.6 V of a low gray level output by the DAC is divided into 32 voltages has resolution higher than a case where an output voltage 12 V of a high gray level output by the DAC is divided into 32 voltages, as shown in FIG. 6.

FIG. 8 illustrates an exemplary configuration of the gamma reference voltage generation circuit connected to a 256-gray scale resistance string according to the first implementation.

As shown in FIG. 8, 8 gamma reference voltages VRG1 to VRG8 generated by the gamma reference voltage generation circuit are respectively applied to tap terminals Tap1 to Tap8 of a 256-gray scale resistance string. Buffers are respectively connected between the tap terminals Tap1 to Tap8 and DACs to stabilize the gamma reference voltages VRG1 to VRG8. A high potential bias input terminal of the DAC used to generate the gamma reference voltage VRG8 of a maximum gray level is connected to an external bias control unit. The external bias control unit includes a plurality of resistors connected between a high potential voltage source VDD and a ground level voltage source GND. The external bias control unit allows a level of a high potential bias voltage applied to a high potential bias input terminal of an uppermost DAC to change by controlling resistances of the resistors. Even if only the high potential bias voltage applied to the uppermost DAC changes by controlling the resistances of the resistors of the external bias control unit, all of high potential bias voltages applied to the remaining DACs change. Therefore, a process for correcting an output luminance or a color coordinate can be performed more easily in the first implementation.

Figure 9:
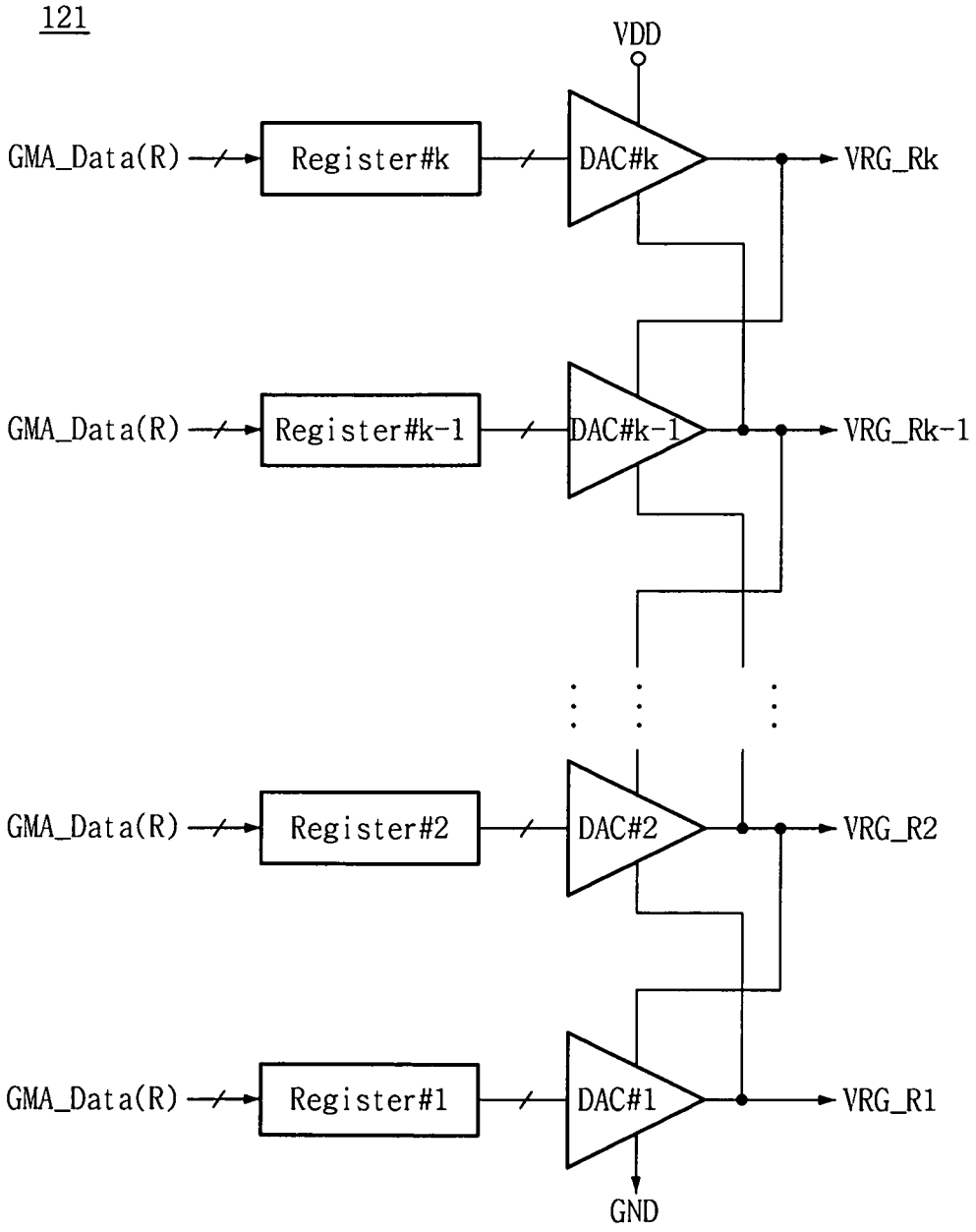
FIGS. 9 and 10 illustrate a second implementation of an R gamma reference voltage generator of a gamma reference voltage generation circuit according to an embodiment.
Figure 10:
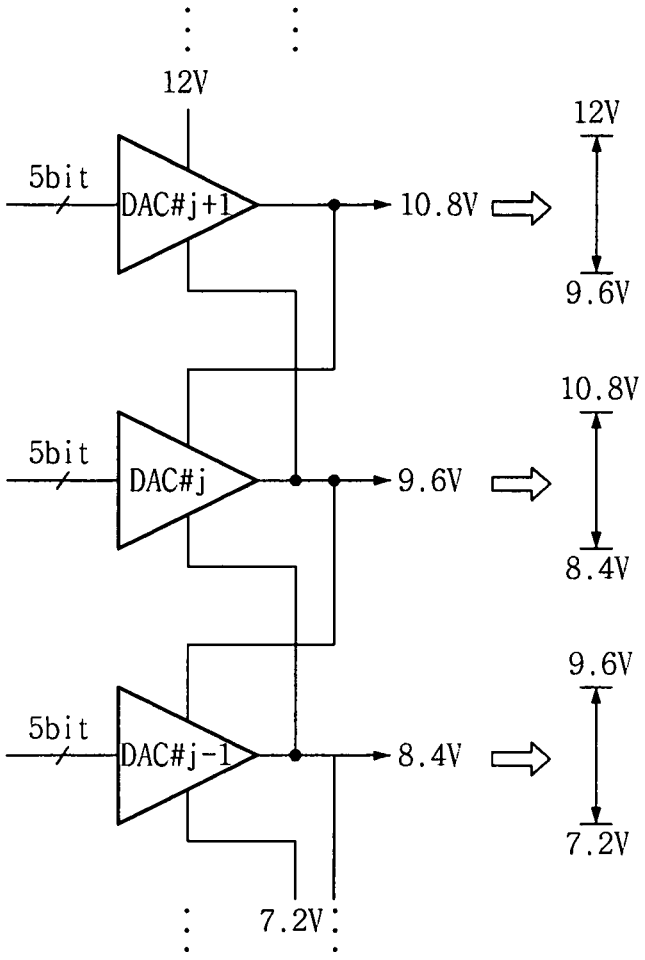

FIGS. 9 and 10 illustrate a second implementation of the R gamma reference voltage generator 121 of the gamma reference voltage generation circuit 12. Since configurations of the G gamma reference voltage generator 122 and the B gamma reference voltage generator 123 are substantially the same as the R gamma reference voltage generator 121 except input and output signals, a further description may be briefly made or may be entirely omitted.

As shown in FIG. 9, the R gamma reference voltage generator 121 includes k registers, into which R gamma data GMA_Data(R) is loaded, and k DACs, that are respectively connected to the k registers to generate R gamma reference voltages corresponding to data values stored in the k registers.

Figure 11:
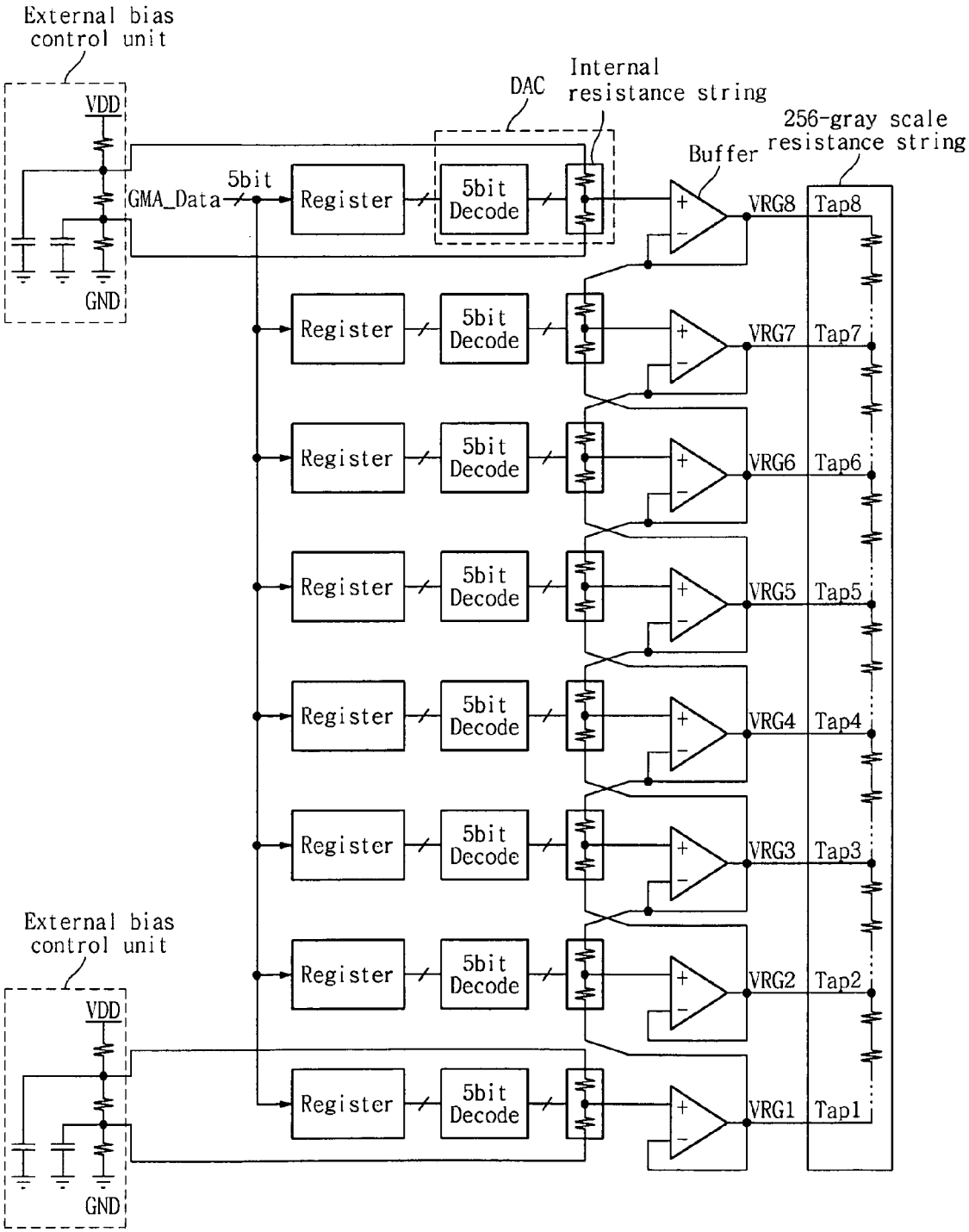
FIG. 11 illustrates an exemplary configuration of a gamma reference voltage generation circuit connected to a 256-gray scale resistance string according to the second implementation.

Each DAC includes a decoder for decoding the R gamma data GMA_Data(R) and a voltage division internal resistance string for selecting an R gamma reference voltage VRG_R depending on the decoded R gamma data GMA_Data(R). The number of voltage division nodes in the internal resistance string may vary depending on a bit rate of the R gamma data GMA_Data(R). For example, if the R gamma data GMA_Data(R) is 5-bit, the internal resistance string may have 25 voltage division nodes. Voltage levels of the voltage division nodes are determined by a high potential bias voltage and a low potential bias voltage applied to both terminals of the internal resistance string. A high potential bias voltage input terminal of each of the DACs is connected to an output terminal of an upper DAC directly next to it, and a low potential bias voltage input terminal of each of the DACs is connected to an output terminal of a lower DAC directly next to it. Namely, the DACs of the R gamma reference voltage generator are cascade-connected to one another. A high potential bias voltage input terminal of an uppermost DAC of the R gamma reference voltage generator is directly connected to a high potential voltage source VDD or is connected to the high potential voltage source VDD via an external bias control unit as shown in FIG. 11. A low potential bias voltage input terminal of a lowermost DAC of the R gamma reference voltage generator is directly connected to a ground level voltage source GND or is connected to the ground level voltage source GND via the external bias control unit as shown in FIG. 11.

For example, as shown in FIG. 10, a high potential bias voltage input terminal of a (j+1)-th DAC is connected to an output terminal (having 12 V) of its upper DAC, a high potential bias voltage input terminal of a j-th DAC is connected to an output terminal (having 10.8 V) of the (j+1)-th DAC, and a high potential bias voltage input terminal of a (j−1)-th DAC is connected to an output terminal (having 9.6 V) of the j-th DAC. A low potential bias voltage input terminal of the (j+1)-th DAC is connected to the output terminal (having 9.6 V) of the j-th DAC, a low potential bias voltage input terminal of the j-th DAC is connected to the output terminal (having 8.4 V) of the (j−1)-th DAC, and a low potential bias voltage input terminal of the (j−1)-th DAC is connected to an output terminal (having 7.2 V) of its lower DAC. Hence, the (j+1)-th DAC outputs a divided voltage of 10.8 V corresponding to a decoding value of the R gamma data GMA_Data(R) (=5-bit) among 32 divided voltages within a range between 9.6 V and 12 V as a (j+1)-th gamma reference voltage to thereby generate a gamma reference voltage of a relatively high gray level. The j-th DAC outputs a divided voltage of 9.6 V corresponding to the decoding value of the R gamma data GMA_Data(R) (=5-bit) among 32 divided voltages within a range between 8.4 V and 10.8 V as a j-th gamma reference voltage to thereby generate a gamma reference voltage of a relatively middle gray level. The (j−1)-th DAC outputs a divided voltage of 8.4 V depending on a decoding value of the R gamma data GMA_Data(R) (=5-bit) among 32 divided voltages within a range between 7.2 V and 9.6 V as a (j−1)-th gamma reference voltage to thereby generate a gamma reference voltage of a relatively low gray level.

As can be seen from the example illustrated in FIG. 10, because the gamma reference voltage generation circuit according to the second implementation includes the cascade-connected DACs, when a corresponding gamma reference voltage having a predetermined range needs to change so that an output luminance and a color coordinate are corrected, only the corresponding gamma reference voltage is individually controlled. In other words, all of gamma reference voltages other than the corresponding gamma reference voltage are automatically controlled in conformity with a desired gamma curve by controlling only the corresponding gamma reference voltage.

Further, because the gamma reference voltage generation circuit according to the second implementation includes the cascade-connected DACs, a gamma representation on a gamma curve of 1.8 to 2.2 can be achieved more precisely by increasing an output precision of the DAC in all of gray ranges.

FIG. 11 illustrates an exemplary configuration of a gamma reference voltage generation circuit connected to a 256-gray scale resistance string according to the second implementation.

As shown in FIG. 11, 8 gamma reference voltages VRG1 to VRG8 generated by the gamma reference voltage generation circuit are respectively applied to tap terminals Tap1 to Tap8 of a 256-gray scale resistance string. Buffers are respectively connected between the tap terminals Tap1 to Tap8 and DACs to stabilize the gamma reference voltages VRG1 to VRG8. High and low potential bias input terminals of a DAC used to generate the gamma reference voltage VRG8 of a maximum gray level and high and low potential bias input terminals of a DAC used to generate the gamma reference voltage VRG1 of a minimum gray level are connected to an external bias control unit. The external bias control unit includes a plurality of resistors connected between a high potential voltage source VDD and a ground level voltage source GND. The external bias control unit allows a level of a high potential bias voltage applied to high and low potential bias input terminals of an uppermost DAC and a level of a high potential bias voltage applied to high and low potential bias input terminals of a lowermost DAC to change by controlling resistances of the resistors. Even if only the bias voltages applied to the uppermost DAC and/or the lowermost DAC change by controlling the resistances of the resistors of the external bias control unit, all of high potential bias voltages applied to the remaining DACs change. Therefore, a process for correcting an output luminance or a color coordinate can be performed more easily in the second implementation.

Figure 12:
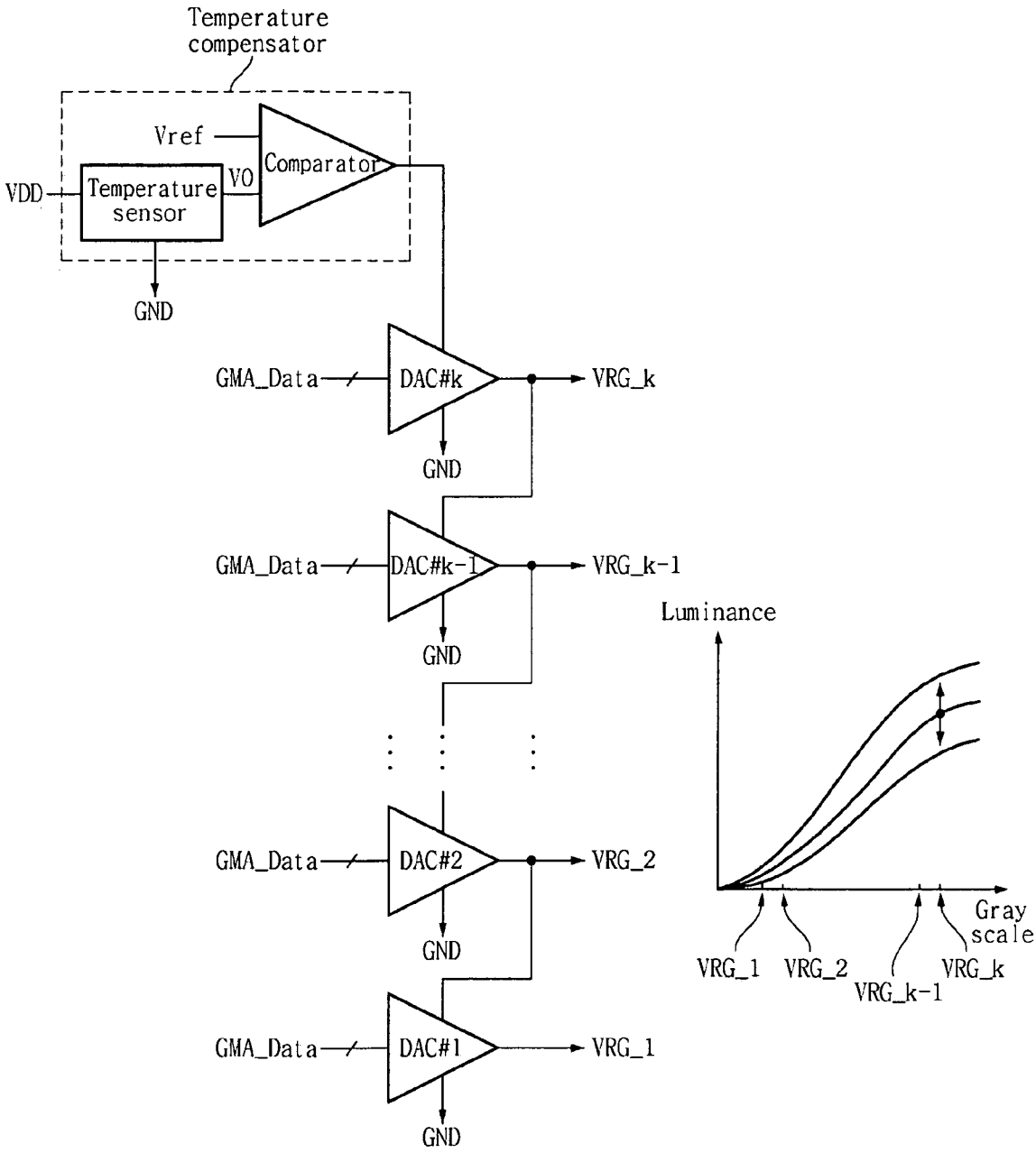
FIG. 12 illustrates a third implementation of a gamma reference voltage generator of a gamma reference voltage generation circuit according to an embodiment.

FIG. 12 illustrates a third implementation of a gamma reference voltage generator of a gamma reference voltage generation circuit according to an embodiment. The gamma reference voltage generator illustrated in FIG. 12 may be one of R, G, and B gamma reference voltage generators.

Since a configuration of the gamma reference voltage generator according to the third implementation is substantially the same as the R gamma reference voltage generator illustrated in FIG. 5 except a temperature compensator connected to a high potential bias input terminal of an uppermost DAC, a further description may be briefly made or may be entirely omitted.

A temperature compensator includes a temperature sensor and a comparator.

The temperature sensor is connected between a high potential voltage source VDD and a ground level voltage source GND and includes a negative temperature coefficient (NTC) thermistor, etc. The temperature sensor lowers an output voltage Vo of the temperature sensor when a temperature of the display panel is higher than a normal temperature (about 25 □), and increases the output voltage Vo of the temperature sensor when the temperature of the display panel is lower than the normal temperature (about 25 □).

The comparator differentially amplifies the output voltage Vo of the temperature sensor and a predetermined reference voltage Vref and supplies the amplified voltages to a high potential bias input terminal of an uppermost DAC.

In the gamma reference voltage generation circuit according to the third implementation, because the temperature sensor lowers a high potential bias voltage of the uppermost DAC at a high temperature higher than the normal temperature and increases the high potential bias voltage of the uppermost DAC at a low temperature lower than the normal temperature, high potential bias voltages of all of the DACs can be automatically controlled depending on changes in the temperature of the display panel. Hence, a reduction in the display quality caused by changes in the temperature of the display panel may be previously prevented. For example, a phenomenon, in which an output luminance increases at a high temperature and the output luminance decreases at a low temperature, may be previously prevented.

As described above, in the gamma reference voltage generation circuit and the flat panel display using the same according to the embodiment, the gamma correction for connecting the output luminance or the color coordinate can be performed more simply through the cascade-connected DACs. Further, the gamma correction at a low gray level or all of the gray ranges can be performed more precisely Furthermore, the gamma reference voltage generation circuit and the flat panel display using the same according to the embodiment include the cascade-connected DACs and the temperature compensator connected to the high potential bias input terminal of the uppermost DAC to previously prevent a reduction in the display quality caused by temperature changes.

It will be apparent to those skilled in the art that various modifications and variations can be made in the embodiments of the invention without departing from the spirit or scope of the invention. Thus, it is intended that embodiments of the invention cover the modifications and variations of this invention provided they come within the scope of the appended claims and their equivalents.

What is claimed is:

1. A gamma reference voltage generation circuit comprising:

a red (R) gamma reference voltage generator including a plurality of digital-to-analog converters (DACs), each of which generates an R gamma reference voltage corresponding to R gamma data;

a green (G) gamma reference voltage generator including a plurality of DACs, each of which generates a G gamma reference voltage corresponding to G gamma data; and a blue (B) gamma reference voltage generator including a plurality of DACs, each of which generates a B gamma reference voltage corresponding to B gamma data, wherein in the DACs of each of the R, G and B gamma reference voltage generators that receive respective R, G and B gamma data, a high potential bias voltage input terminal of an uppermost DAC used to generate a gamma reference voltage of a maximum gray level is connected to a high potential voltage source, and wherein an output of the uppermost DAC is connected to a high potential bias voltage input terminal of a next DAC such that a high potential bias voltage input terminal of each of remaining DACs except the uppermost DAC is cascade-connected to an output terminal of an upper DAC next to each of the remaining DACs, and wherein the high potential bias voltage input terminal of each of the DACs is connected to an internal resistance string included in each of the DACs, wherein the high potential bias voltage input terminal of the uppermost DAC is connected to the high potential voltage source through a temperature compensator, wherein the temperature compensator includes:

a temperature sensor that is connected to the high potential voltage source to lower an output voltage of the temperature sensor when an ambient temperature is higher than a normal temperature and to increase the output voltage of the temperature sensor when the ambient temperature is lower than the normal temperature; and a comparator that differentially amplifies the output voltage of the temperature sensor and a predetermined reference voltage and supplies the amplified voltages to the high potential bias input terminal of the uppermost DAC.

2. The gamma reference voltage generation circuit of claim 1, wherein low potential bias voltage input terminals of the DACs are commonly connected to a ground level voltage source.

3. The gamma reference voltage generation circuit of claim 1, wherein in the DACs of each of the R, G and B gamma reference voltage generators, a low potential bias voltage input terminal of a lowermost DAC used to generate a gamma reference voltage of a minimum gray level is connected to a ground level voltage source, and wherein a low potential bias voltage input terminal of each of remaining DACs except the lowermost DAC is cascade-connected to an output terminal of a lower DAC next to each of the remaining DACs.

4. A flat panel display comprising:

a display panel including red (R), green (G) and blue (B) pixels;

a memory that stores R, G and B gamma data received from the outside;

a gamma reference voltage generation circuit that generates a plurality of R, G and B gamma reference voltages corresponding to the R, G and B gamma data loaded from the memory; and a data driving circuit that divides each of the plurality of R, G and B gamma reference voltages to generate a plurality of R, G and B gamma voltages and supplies the R, G and B gamma voltages as a data voltage to the display panel, wherein the gamma reference voltage generation circuit includes R, G and B gamma reference voltage generators each having a plurality of digital-to-analog converters (DACs) that generate the plurality of R, G and B gamma reference voltages, wherein in the DACs of each of the R, G and B gamma reference voltage generators that receive respective R, G and B gamma data, a high potential bias voltage input terminal of an uppermost DAC used to generate a gamma reference voltage of a maximum gray level is connected to a high potential voltage source, and wherein an output of the uppermost DAC is connected to a high potential bias voltage input terminal of a next DAC such that a high potential bias voltage input terminal of each of remaining DACs except the uppermost DAC is cascade-connected to an output terminal of an upper DAC next to each of the remaining DACs, and wherein the high potential bias voltage input terminal of each of the DACs is connected to an internal resistance string included in each of the DACs, wherein the high potential bias voltage input terminal of the uppermost DAC is connected to the high potential voltage source through a temperature compensator, wherein the temperature compensator includes:

a temperature sensor that is connected to the high potential voltage source to lower an output voltage of the temperature sensor when an ambient temperature is higher than a normal temperature and to increase the output voltage of the temperature sensor when the ambient temperature is lower than the normal temperature; and a comparator that differentially amplifies the output voltage of the temperature sensor and a predetermined reference voltage and supplies the amplified voltages to the high potential bias input terminal of the uppermost DAC.

5. The flat panel display of claim 4, wherein low potential bias voltage input terminals of the DACs are commonly connected to a ground level voltage source.

6. The flat panel display of claim 4, wherein in the DACs of each of the R, G and B gamma reference voltage generators, a low potential bias voltage input terminal of a lowermost DAC used to generate a gamma reference voltage of a minimum gray level is connected to a ground level voltage source, and wherein a low potential bias voltage input terminal of each of remaining DACs except the lowermost DAC is cascade-connected to an output terminal of a lower DAC next to each of the remaining DACs.

* * * * *